US011250814B2

(12) United States Patent
Nadami et al.

(10) Patent No.: US 11,250,814 B2
(45) Date of Patent: Feb. 15, 2022

(54) DISPLAY DEVICE

(71) Applicant: SHARP KABUSHIKI KAISHA, Sakai (JP)

(72) Inventors: Toshitaka Nadami, Sakai (JP); Kazuhiko Yoda, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/193,422

(22) Filed: Mar. 5, 2021

(65) Prior Publication Data

US 2021/0295799 A1 Sep. 23, 2021

(30) Foreign Application Priority Data

Mar. 18, 2020 (JP) ..... JP2020-048347

(51) Int. Cl.
*G09G 5/10* (2006.01)
*G09G 3/32* (2016.01)

(52) U.S. Cl.
CPC ..... *G09G 5/10* (2013.01); *G09G 3/32* (2013.01); *G09G 2310/027* (2013.01); *G09G 2320/064* (2013.01); *G09G 2360/141* (2013.01)

(58) Field of Classification Search
CPC ..... G09G 2320/064; G09G 3/32; G09G 2360/141; G09G 5/10; G09G 2310/027
See application file for complete search history.

(56) References Cited

U.S. PATENT DOCUMENTS

2012/0147291 A1* 6/2012 Seo ..... G09G 3/342 349/62
2013/0147356 A1 6/2013 Masumoto
2013/0265348 A1* 10/2013 Onogi ..... G09G 5/10 345/691
2019/0228718 A1* 7/2019 Lee ..... G09G 3/2018

FOREIGN PATENT DOCUMENTS

JP 2013-122846 A 6/2013

* cited by examiner

*Primary Examiner* — Muhammad N Edun
(74) *Attorney, Agent, or Firm* — ScienBiziP, P.C.

(57) ABSTRACT

A display device includes a PWM signal generating part configured to set a duty ratio for each period of a pulse width modulation signal, and configured to generate an intermediate gray scale signal including a signal including a first pulse width modulation signal continuous to a second pulse width modulation signal corresponding to two duty ratios closest to each other among M types of duty ratios, based on a signal related to luminance from an input device.

5 Claims, 8 Drawing Sheets

| | |
|---|---|
| A⇒A⇒A⇒A⇒A⇒A⇒A⇒B | (A+A+A+A+A+A+A+B) ÷8 GRAY SCALE |
| ⇩ | |
| A⇒A⇒A⇒A⇒A⇒A⇒B⇒B | (A+A+A+A+A+A+B+B) ÷8 GRAY SCALE |
| ⇩ | |
| A⇒A⇒A⇒A⇒A⇒B⇒B⇒B | (A+A+A+A+A+B+B+B) ÷8 GRAY SCALE |
| ⇩ | |
| A⇒A⇒A⇒A⇒B⇒B⇒B⇒B | (A+A+A+A+B+B+B+B) ÷8 GRAY SCALE |
| ⇩ | |
| A⇒A⇒A⇒B⇒B⇒B⇒B⇒B | (A+A+A+B+B+B+B+B) ÷8 GRAY SCALE |
| ⇩ | |
| A⇒A⇒B⇒B⇒B⇒B⇒B⇒B | (A+A+B+B+B+B+B+B) ÷8 GRAY SCALE |
| ⇩ | |
| A⇒B⇒B⇒B⇒B⇒B⇒B⇒B | (A+B+B+B+B+B+B+B) ÷8 GRAY SCALE |
| ⇩ | |
| B⇒B⇒B⇒B⇒B⇒B⇒B⇒B | (B+B+B+B+B+B+B+B) ÷8 GRAY SCALE |

FIG. 4

DISPLAY DEVICE

CROSS-REFERENCE TO RELATED APPLICATIONS

This application claims the benefit of priority to Japanese Patent Application Number 2020-048347 filed on Mar. 18, 2020. The entire contents of the above-identified application are hereby incorporated by reference.

BACKGROUND

The disclosure relates to a display device.

TECHNICAL FIELD

Technique of optimizing brightness of an entire display device in accordance with brightness in a periphery where the display device is used has been implemented.

JP 2013-122846 A (published on Jun. 20, 2013) describes technique of combining control of an output to an LED element (control of a current value), control of a duty ratio of a pulse width modulation signal (a PWM signal), and control of the number of lighted LED elements, and performing brightness adjustment more finely.

SUMMARY

However, since the method of controlling the number of lighted LED elements and the method of controlling an output to an LED element (control of a current value) described in the above-described JP 2013-122846 A (published Jun. 20, 2013) is a method where resolution of brightness adjustment is low, the method is not very suitable for finer adjustment of brightness. In addition, since the method of controlling a duty ratio of a pulse width modulation signal (a PWM signal) described in the above-described JP 2013-122846 A (published Jun. 20, 2013) is a method where a period of setting a duty ratio of a pulse width modulation signal (a PWM signal) is long, the method is a method that does not contribute much to finer adjustment of brightness.

In view of the above-described problems, an object of the disclosure is to provide a display device including a backlight that can perform a change in brightness more smoothly.

To solve the above-described problems, a display device according to an aspect of the disclosure includes an input device, a pulse width modulation signal generating part, a drive circuit having M (where M is a natural number of two or more) types of duty ratio resolution, a backlight including a plurality of light-emitting elements, and a display panel overlapping the backlight, wherein the pulse width modulation signal generating part sets the duty ratio for each period of a pulse width modulation signal, and generates an intermediate gray scale signal including a signal including a first pulse width modulation signal continuous to a second pulse width modulation signal corresponding to two duty ratios closest to each other among the M types of duty ratios, based on a signal related to luminance from the input device, and the drive circuit controls a plurality of light-emitting elements of the backlight, based on the intermediate gray scale signal.

According to an aspect of the disclosure, a display device including a backlight that can perform a change in brightness more smoothly can be realized.

BRIEF DESCRIPTION OF DRAWINGS

The disclosure will be described with reference to the accompanying drawings, wherein like numbers reference like elements.

FIG. 4 is a view illustrating an example of a signal generated by the PWM signal generating part provided in the display device of the present embodiment.

DESCRIPTION OF EMBODIMENTS

Embodiments of the disclosure will be described with reference to FIGS. 1 to 8 as follows.

Figure 1:
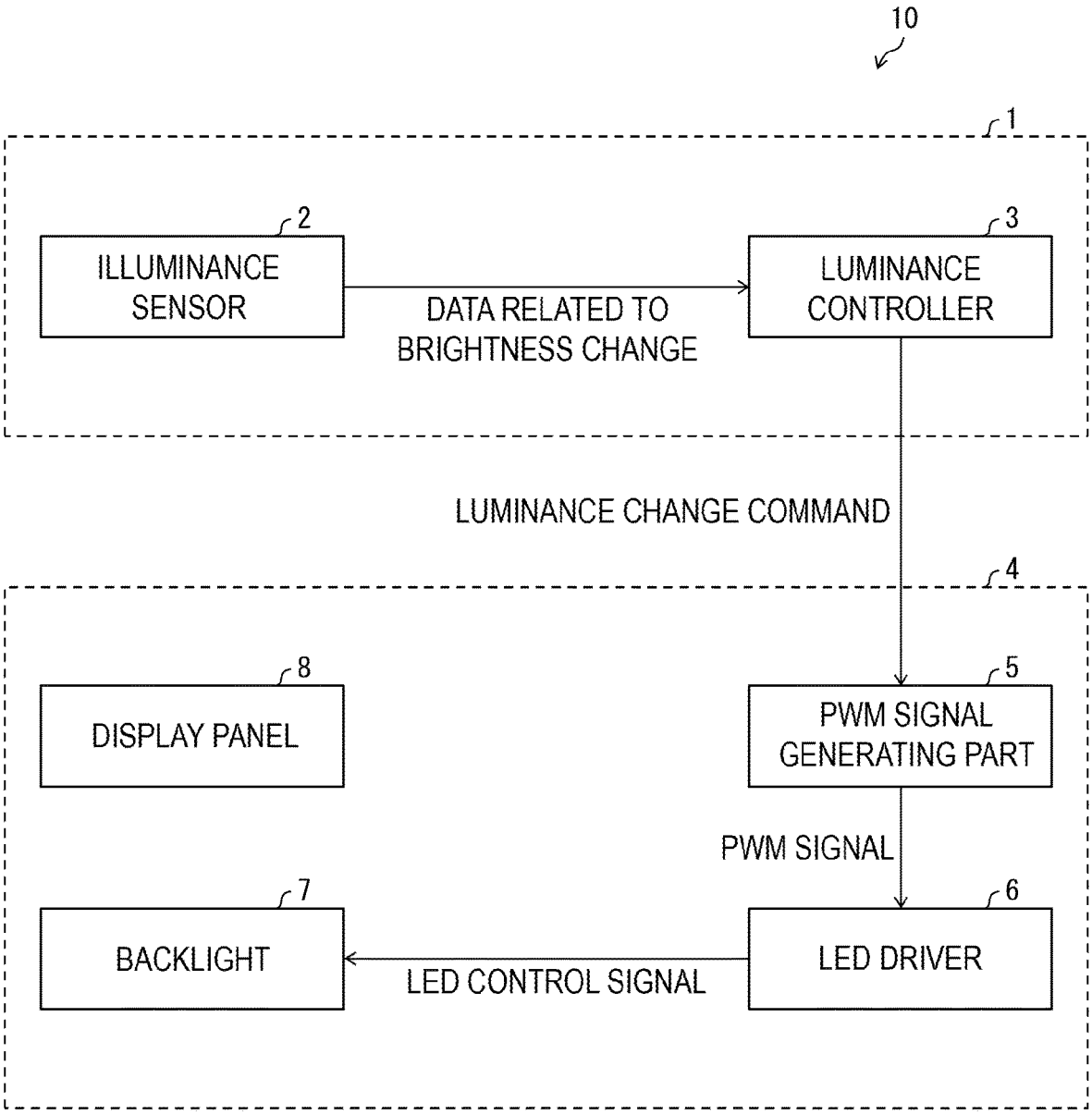
FIG. 1 is a view illustrating a schematic configuration of a display device of the present embodiment.

FIG. 1 is a view illustrating a schematic configuration of a display device 10 of the present embodiment.

As illustrated in FIG. 1, the display device 10 includes an input device 1 and a display module 4. The input device 1 includes an illuminance sensor 2 and a luminance controller 3. The display module 4 includes a PWM signal generating part (a pulse width modulation signal generating part) 5, an LED driver (a drive circuit) 6 having M (where M is a natural number of two or more) types of duty ratio resolution, a backlight 7 including a plurality of light-emitting elements (LED elements), and a display panel 8 overlapping the backlight 7.

In the input device 1, the illuminance sensor 2 detects brightness in a periphery, and based on a result of the detection, the luminance controller 3 outputs, to the display module 4, a luminance change command (a signal related to luminance) for optimizing brightness of the backlight 7 in accordance with a change in brightness in a periphery. For example, in a case where a detection result indicating that brightness in a periphery is dark is obtained from the illuminance sensor 2, the luminance controller 3 outputs, to the display module 4, a luminance change command (a signal related to luminance) to smoothly decrease luminance of the backlight 7 to predetermined luminance, and in a case where a detection result indicating that brightness in a periphery is bright is obtained from the illuminance sensor 2, the luminance controller 3 outputs, to the display module 4, a luminance change command (a signal related to luminance) to smoothly increase luminance of the backlight 7 to predetermined luminance. Note that the luminance change command (the signal related to luminance) from the luminance controller 3 may be transferred to the display module 4 via I2C communication, for example.

In the present embodiment, the case where the input device 1 includes the illuminance sensor 2 is exemplarily described, but the embodiment is not limited to this case, and the input device 1 may include, for example, a luminance setting unit that enables a user of the display device 10 to set preferred luminance, instead of the illuminance sensor 2.

Note that, for example, a liquid crystal display panel or the like can be used as the display panel 8.

Figure 2:
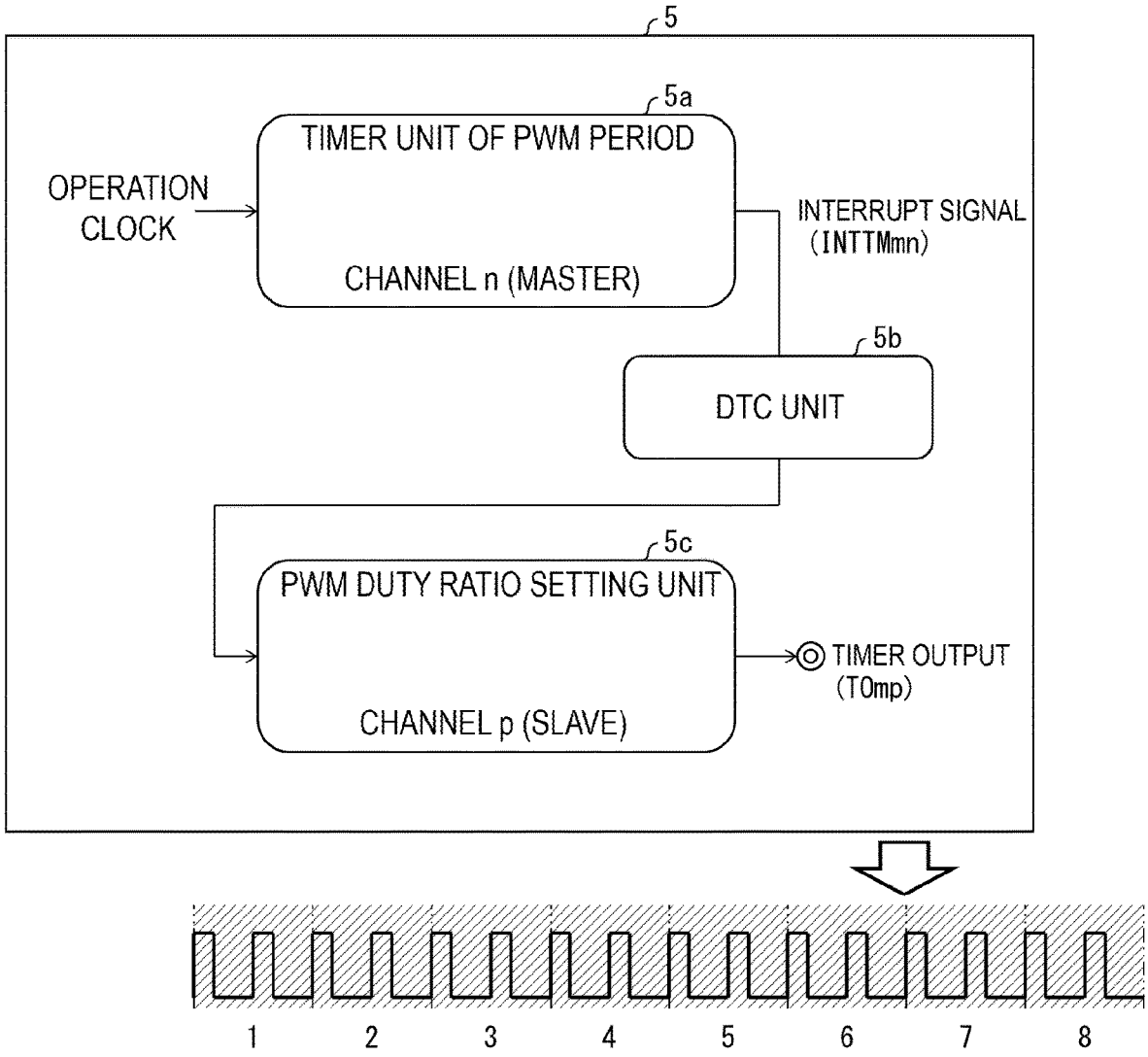
FIG. 2 is a view illustrating a schematic configuration of a PWM signal generating part provided in the display device of the present embodiment.

FIG. 2 is a view illustrating a schematic configuration of the PWM signal generating part 5 provided in the display device 10.

As illustrated in FIG. 2, the PWM signal generating part 5 includes a timer unit of a PWM period 5*a*, a data transfer controller (DTC) unit 5*b*, and a PWM duty ratio setting unit (a pulse width modulation signal duty ratio setting unit) 5*c*.

Note that the PWM signal generating part 5 can include, for example, a microcomputer.

Note that a data transfer controller (DTC) function provided in the DTC unit 5*b* is a function to transfer data between memories without using a CPU. The DTC unit 5*b* can use the same data bus as the CPU, and a bus usage right for a DTC is prioritized over the CPU.

Since the PWM signal generating part 5 provided in the display device 10 includes the DTC unit 5*b* described below, a PWM duty ratio can be set for each period of a PWM signal (a pulse width modulation signal). In addition, the PWM signal generating part 5 generates an intermediate gray scale signal including a signal including a first pulse width modulation signal continuous to a second pulse width modulation signal corresponding to two duty ratios closest to each other among the M types of duty ratios, based on the luminance change command (the signal related to luminance) from the luminance controller 3.

In the present embodiment, the case where the PWM duty ratio can be set for each period of the PWM signal by providing the DTC unit 5*b* is exemplarily described, but the embodiment is not limited to this case.

In addition, in the present embodiment, the case where the PWM signal of 2600 Hz, that is, a signal having one period of the PWM signal of 0.384 msec is used is exemplarily described, but the embodiment is not limited to this case. To enable a user of the display device 10 to more smoothly recognize a change in luminance of the backlight 7, a frequency of the PWM signal is preferably equal to or greater than 2600 Hz.

In addition, in the present embodiment, an LED driver having 1024 types of duty ratio resolution is used as the LED driver 6 having the M (where M is a natural number of two or more) types of duty ratio resolution, but the embodiment is not limited to this case, and as necessary, an LED driver having predetermined duty ratio resolution can be selected appropriately.

As illustrated in FIG. 2, the timer unit of a PWM period 5*a* (also referred to as a channel n (master)) outputs an interrupt signal (INTTMmn) to the DTC unit 5*b* every 0.384 msec that are one period of the PWM signal, based on an operation clock (a basic operation clock). Then, the DTC unit 5*b* rewrites a duty ratio of the PWM duty ratio setting unit (also referred to as a channel p (slave)) 5*c*, based on the interrupt signal (INTTMmn). The PWM duty ratio setting unit 5*c* performs a timer output of the PWM signal at predetermined timing, based on a rewritten duty ratio.

Note that FIG. 2 illustrates the case where one period of the PWM signal is 0.384 msec, and the PWM signal having the same duty ratio of each period is output from the PWM signal generating part 5.

To control the plurality of LED elements of the backlight 7 to obtain luminance of a pseudo-intermediate gray scale other than the 1024 types of duty ratio resolution of the LED driver 6, the intermediate gray scale signal in the PWM signal includes N (N is a natural number of two or more) periods of the PWM signal, and each period of the N periods of the PWM signal includes a first pulse width modulation signal and a second pulse width modulation signal corresponding to two duty ratios closest to each other among the 1024 types of duty ratios.

In the present embodiment, the case where the intermediate gray scale signal in the PWM signal includes 2N (N is a natural number of 2 or more) periods of the PWM signal, and each period of the 2N periods of the PWM signal includes the first pulse width modulation signal and the second pulse width modulation signal corresponding to the two duty ratios closest to each other among the 1024 types of duty ratios, and continuous two periods of the PWM signal include one of the first pulse width modulation signal and the second pulse width modulation signal, alone is exemplarily described, but the embodiment is not limited to this case. For example, the intermediate gray scale signal in the PWM signal may include N (N is a natural number of two or more) periods of the PWM signal, and each period of the N periods of the PWM signal may include the first pulse width modulation signal and the second pulse width modulation signal corresponding to the two duty ratios closest to each other among the 1024 types of duty ratios.

Figure 3:
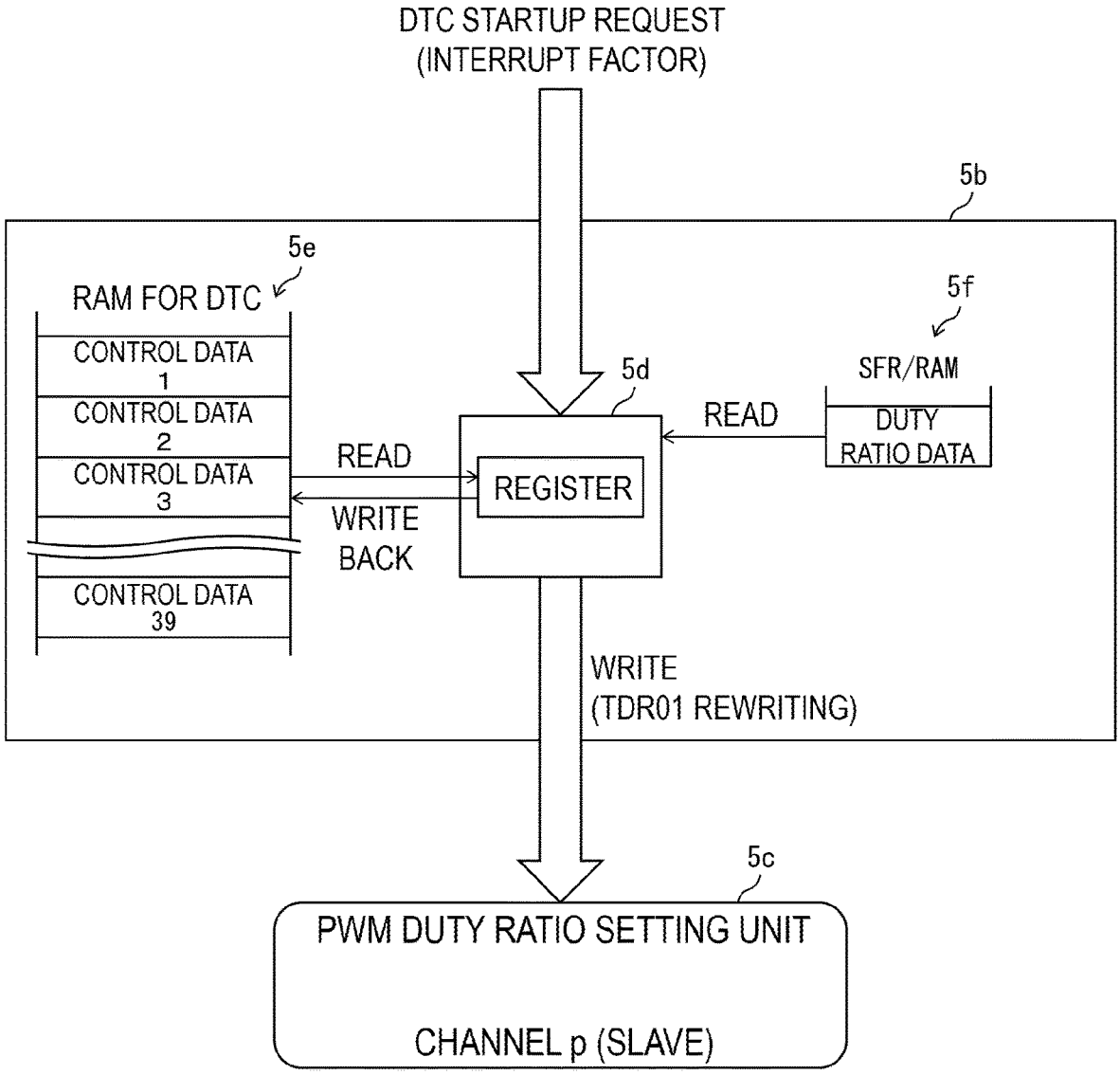
FIG. 3 is a view illustrating a schematic configuration of a DTC unit provided in the PWM signal generating part of the display device of the present embodiment.

FIG. 3 is a view illustrating a schematic configuration of the DTC unit 5*b* provided in the PWM signal generating part 5 of the display device 10.

As illustrated in FIG. 3, the DTC unit 5*b* includes a controller 5*d* including a register, a first memory (for example, an RAM for DTC) 5*e* where a plurality of pieces of control data 1 to control data 39 are stored to drive the controller 5*d*, and a second memory (for example, an SFR/RAM) 5*f* where each piece of duty ratio data (illustrated in FIG. 4) constituting the intermediate gray scale signal is stored.

As illustrated in FIG. 3, the controller 5*d* including a register reads one or more pieces of the control data 1 to 39 from the first memory 5*e*, based on the interrupt signal (INTTMmn) generated for each period of the PWM signal by the timer unit of a PWM period 5*a* illustrated in FIG. 2, that is, a DTC startup request (an interrupt factor), and the controller 5*d* including a register reads predetermined duty ratio data from the second memory 5*f*, based on read control data, and writes the predetermined duty ratio data in the PWM duty ratio setting unit 5*c*, that is, performs TDR01 rewriting to set a duty ratio. Subsequently, the controller 5*d* including a register writes the control data read from the first memory 5*e* back in the first memory 5*e*.

FIG. 4 is a view illustrating an example of a signal generated by the PWM signal generating part provided in the display device 10.

As described above, in the present embodiment, since the LED driver 6 having the 1024 types of duty ratio resolution is used, a PWM duty (%) indicating duty ratio resolution is approximately 0.1% from 1 χ 1024×100.

For example, as illustrated in FIG. 4, in a case where the luminance change command (the signal related to luminance) output from the luminance controller 3 to the display module 4 is from 0.69 PWM duty (%) to 0.79 PWM duty (%), the PWM signal generating part 5 generates the intermediate gray scale signal including the signal including the first pulse width modulation signal (A in FIG. 4) and the second pulse width modulation signal (B in FIG. 4) corresponding to the two duty ratios closest to each other among the 1024 types of duty ratios, based on the luminance change command (the signal related to luminance).

In the present embodiment, the PWM signal for 16 periods illustrated in FIG. 2 is divided into eight types of duration from first duration to eighth duration (1 to 8 in FIG. 2) by a two-period unit, and as illustrated in FIG. 4, two PWM signals for each of the first duration to the seventh duration are the first pulse width modulation signal corresponding to 0.69 PWM duty (%) (A in FIG. 4), and two PWM signals for the eighth duration are the second pulse width modulation signal corresponding to 0.79 PWM duty (%) (B in FIG. 4). Accordingly, the PWM signals from the first duration to the eighth duration are the intermediate gray scale signal corresponding to 0.7025 PWM duty (%). Two PWM signals for each of subsequent ninth duration to sixteenth duration are the first pulse width modulation signal (A in FIG. 4) corresponding to 0.69 PWM duty (%), and two PWM signals from seventeenth duration to eighteenth duration are the second pulse width modulation signal (B in FIG. 4) corresponding to 0.79 PWM duty (%). Accordingly, the PWM signals from the ninth duration to eighteenth duration are the intermediate gray scale signal corresponding to 0.715 PWM duty (%).

As illustrated in FIG. 4, the intermediate gray scale signal for obtaining luminance of a pseudo-intermediate gray scale other than the 1024 types of duty ratio resolution of the LED driver 6 can be generated by increasing proportion of the second pulse width modulation signal corresponding to 0.79 PWM duty (%) one by one.

In the present embodiment, the case where seven stages of intermediate gray scales are provided between 0.69 PWM duty (%) and 0.79 PWM duty (%) is described exemplarily, but the embodiment is not limited to this case, and one or more and six or less stages of intermediate gray scales may be provided between 0.69 PWM duty (%) and 0.79 PWM duty (%).

Note that, in the present embodiment, since the PWM signal for 16 periods is divided into eight types of duration by a two-period unit, seven stages of intermediate gray scales maximum can be provided between 0.69 PWM duty (%) and 0.79 PWM duty (%), but the embodiment is not limited to this case, and in a case where the PWM signal for 16 periods is divided into 16 types of duration by one period unit, 15 stages of intermediate gray scales maximum can be provided between 0.69 PWM duty (%) and 0.79 PWM duty (%).

Figure 6:
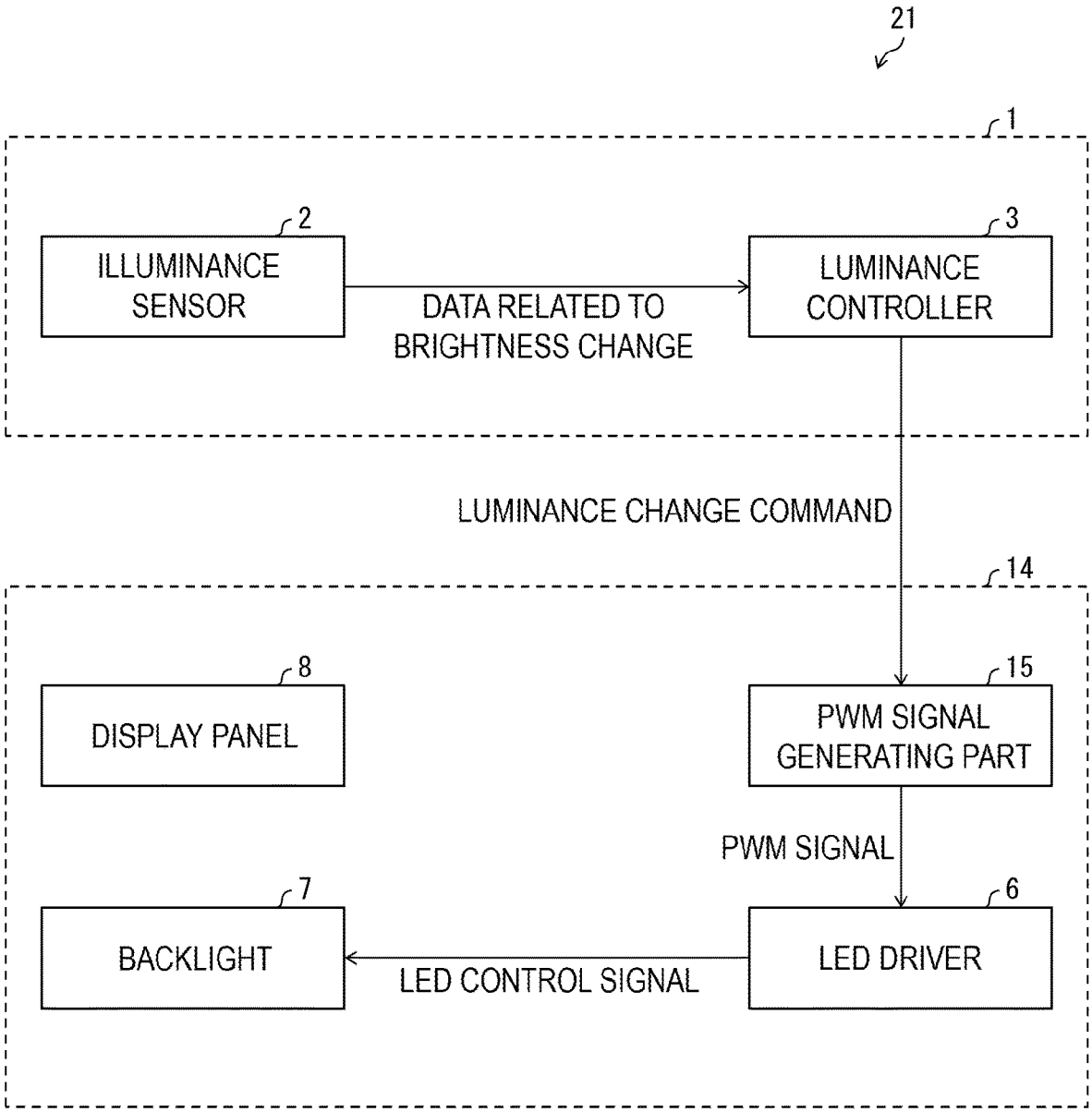
FIG. 6 is a view illustrating a schematic configuration of a display device that is a comparative example.

FIG. 6 is a view illustrating a schematic configuration of a display device 21 that is a comparative example.

The display device 21 that is a comparative example illustrated in FIG. 6 is the same as the display device 10 of the present embodiment illustrated in FIG. 1, except that the display device 21 includes a PWM signal generating part 15.

Figure 7:
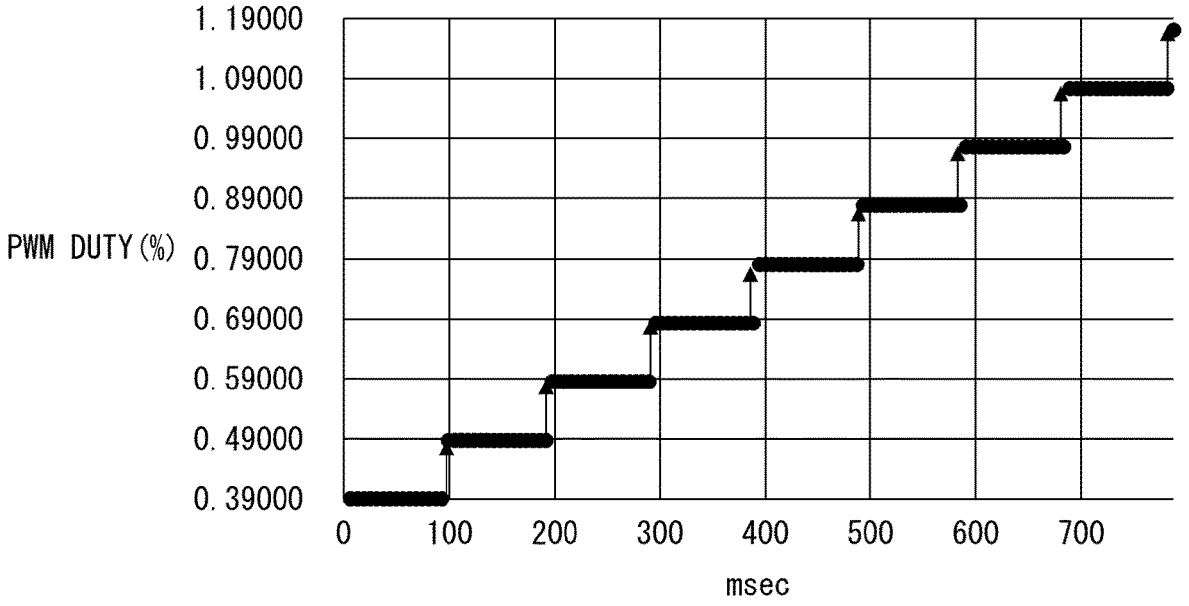
FIG. 7 is a view for explaining a reason that a change in brightness cannot be performed smoothly in a backlight provided in the display device that is the comparative example.

FIG. 7 is a view for explaining a reason that a change in brightness cannot be performed smoothly in a backlight 7 of a display module 14 provided in the display device 21 that is a comparative example.

Figure 8:
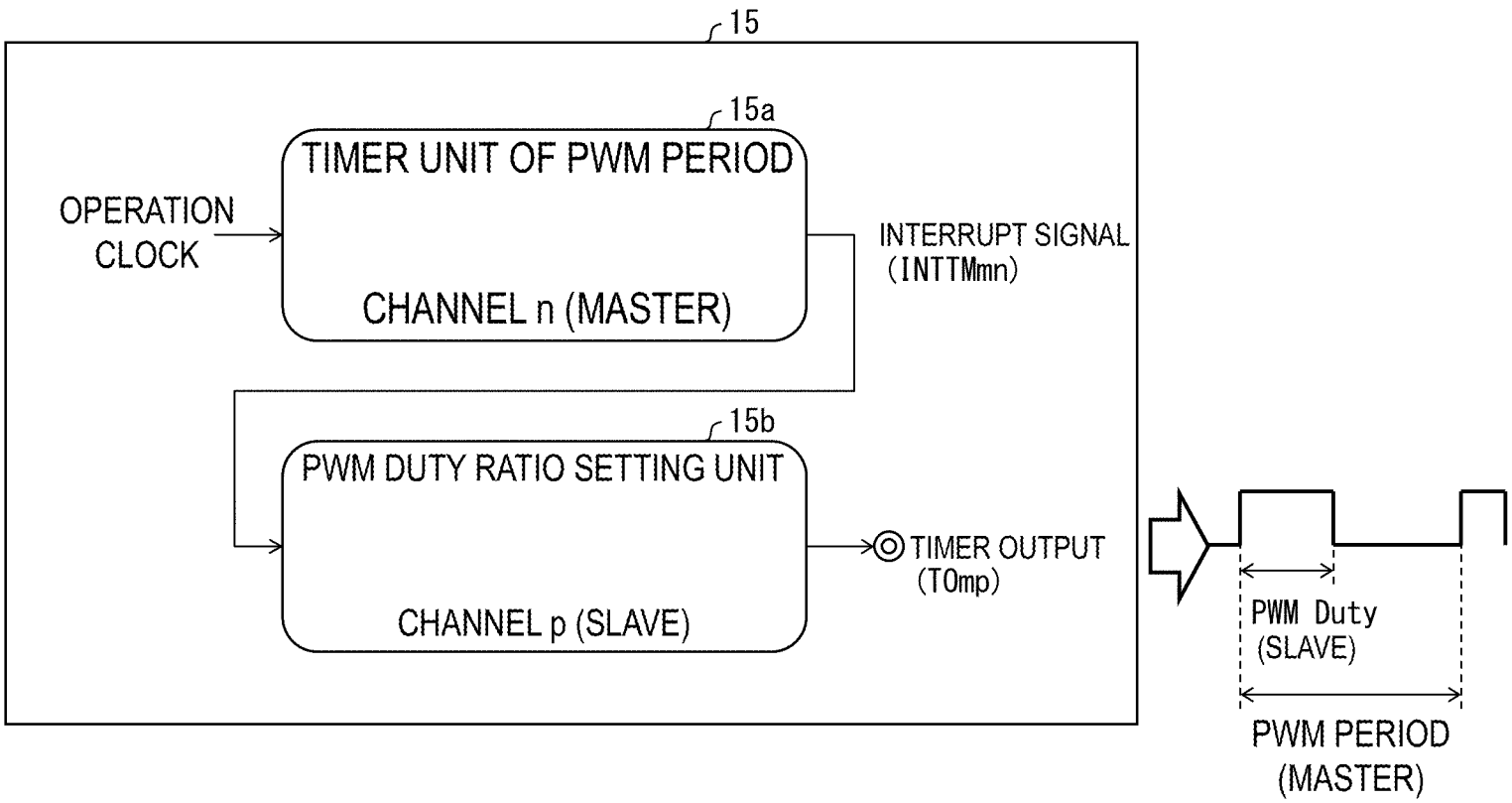
FIG. 8 is a view illustrating a schematic configuration of a PWM signal generating part provided in the display device that is the comparative example.

FIG. 8 is a view illustrating a schematic configuration of the PWM signal generating part 15 provided in the display device 21 that is a comparative example.

As illustrated in FIG. 8, the PWM signal generating part 15 provided in the display device 21 that is the comparative example includes a timer unit of a PWM period 15*a* and a PWM duty ratio setting unit 15*b*. That is, as with the PWM signal generating part 5 illustrated in FIG. 2, since a DTC unit 5*b* is not provided, a PWM duty ratio cannot be set every 0.384 msec that is one period of a PWM signal.

Accordingly, as indicated by an arrow in FIG. 7, in a case where the PWM duty ratio is set every approximately 100 msec, a luminance change command (a signal related to luminance) output from a luminance controller 3 to a display module 14 is, for example, from 0.39 PWM duty (%) to 1.19 PWM duty (%). In this case, an intermediate gray scale signal for obtaining luminance of a pseudo-intermediate gray scale other than 1024 types of duty ratio resolution of a LED driver 6 cannot be generated, and a display device including a backlight that can perform a change in brightness more smoothly cannot be realized.

Figure 5:
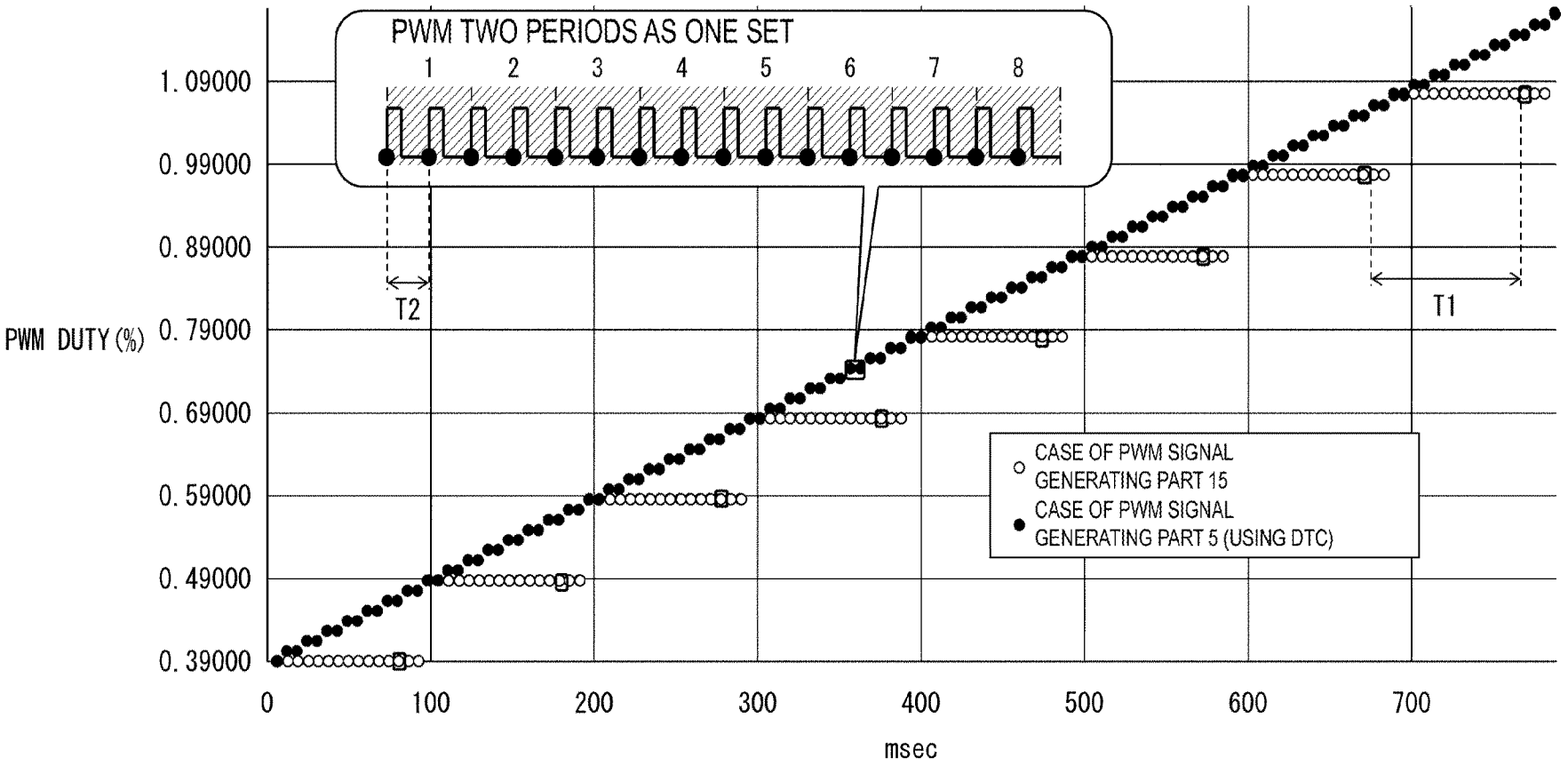
FIG. 5 is a view for explaining a reason that a change in brightness can be performed more smoothly in a backlight provided in the display device of the present embodiment.

FIG. 5 is a view for explaining a reason that a change in brightness can be performed more smoothly in the backlight provided in the display device 10 of the present embodiment.

As illustrated in FIG. 5, LED elements of the backlight provided in the display device 21 (see FIGS. 6, 7 and 8) that is the comparative example are controlled by resolution of approximately 0.1 PWM duty (%) that is the 1024 types of duty ratio resolution of the LED driver 6. On the other hand, the LED elements of the backlight provided in the display device 10 of the present embodiment are also controlled by the intermediate gray scale signal for obtaining luminance of a pseudo-intermediate gray scale other than the 1024 types of duty ratio resolution of the LED driver 6.

Accordingly, the display device 10 including the backlight 7 that can perform a change in brightness more smoothly can be realized.

Note that, in FIG. 5, a period T1 is a rewriting period (approximately 100 msec) of the PWM duty ratio of the display device 21 that is the comparative example, and a period T2 is a rewriting period (approximately 0.384 msec) of the PWM duty ratio in the display device 10 of the present embodiment.

Supplement

First Aspect

A display device including an input device, a pulse width modulation signal generating part, a drive circuit having M (where M is a natural number of two or more) types of duty ratio resolution, a backlight including a plurality of light-emitting elements, and a display panel overlapping the backlight, wherein the pulse width modulation signal generating part sets the duty ratio for each period of a pulse width modulation signal, and generates an intermediate gray scale signal including a signal including a first pulse width modulation signal continuous to a second pulse width modulation signal corresponding to two duty ratios closest to each other among the M types of duty ratios, based on an input signal related to luminance from the input device, and the drive circuit controls a plurality of light-emitting elements of the backlight, based on the intermediate gray scale signal.

Second Aspect

The display device according to aspect 1, wherein the pulse width modulation signal generating part includes a data transfer controller unit and a pulse width modulation signal duty ratio setting unit, the data transfer controller unit includes a controller including a register, a first memory where a plurality of pieces of control data for driving the controller are stored, and a second memory where each duty ratio constituting the intermediate gray scale signal is stored, and the controller reads the control data from the first memory, based on an interrupt signal generated for each period of the pulse width modulation signal, reads the data of a duty ratio from the second memory, based on the control data, writes the data of a duty ratio in the pulse width modulation signal duty ratio setting unit, and sets a duty ratio.

Third Aspect

The display device according to aspect 1 or 2, wherein the input device includes an illuminance sensor and a luminance controller, the illuminance sensor supplies data related to a brightness change to the luminance controller, the luminance controller supplies a luminance change signal to the pulse width modulation signal generating part, based on the data related to a brightness change, and the pulse width modulation signal generating part generates an interrupt signal generated for each period of the pulse width modulation signal, based on the luminance change signal.

Fourth Aspect

The display device according to any one of aspects 1 to 3, wherein a frequency of the pulse width modulation signal is equal to or greater than 2600 Hz.

Fifth Aspect

The display device according to any one of aspects 1 to 4, wherein the intermediate gray scale signal includes N (N is a natural number of two or more) periods of the pulse width modulation signal, and each period of the N periods of the pulse width modulation signal includes the first pulse width modulation signal and the second pulse width modulation signal.

Sixth Aspect

The display device according to any one of aspects 1 to 4, wherein the intermediate gray scale signal includes 2N (N is a natural number of two or more) periods of the pulse width modulation signal, each period of the 2N periods of the pulse width modulation signal includes the first pulse width modulation signal and the second pulse width modulation signal, and continuous two periods of the pulse width modulation signal include one of the first pulse width modulation signal and the second pulse width modulation signal alone.

Additional Items

The disclosure is not limited to each of the embodiments described above, and various modifications can be made within the scope of the claims. An embodiment obtained by appropriately combining the technical approaches disclosed in each of the different embodiments also falls within the technical scope of the disclosure. Further, novel technical features can be formed by combining the technical approaches disclosed in each of the embodiments.

INDUSTRIAL APPLICABILITY

The disclosure can be applied to a display device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A display device comprising:

an input device;

a pulse width modulation signal generating part;

a drive circuit having two or more duty ratios;

a backlight including a plurality of light-emitting elements; and a display panel overlapping the backlight, wherein:

the pulse width modulation signal generating part is configured to:

set a duty ratio for each period of a pulse width modulation signal, and generate, based on a signal related to luminance from the input device, an intermediate gray scale signal including a signal that has a first pulse width modulation signal and a second pulse width modulation signal continuous to the first pulse width modulation signal, the first pulse width modulation signal and the second pulse width modulation signal corresponding to two duty ratios closest to each other among the two or more duty ratios, the drive circuit is configured to control the plurality of light-emitting elements of the backlight based on the intermediate gray scale signal, and the pulse width modulation signal generating part includes:

a data transfer controller unit; and a pulse width modulation signal duty ratio setting unit, wherein the data transfer controller unit includes:

a controller including a register;

a first memory storing a plurality of pieces of control data for driving the controller; and a second memory storing each piece of duty ratio data constituting the intermediate gray scale signal, wherein the controller is configured to:

read one or more pieces of the plurality of pieces of control data from the first memory based on an interrupt signal generated for each period of the pulse width modulation signal, read the piece of duty ratio data from the second memory based on the read one or more pieces of the plurality of pieces of control data, write the piece of duty ratio data in the pulse width modulation signal duty ratio setting unit, and set the duty ratio.

2. The display device according to claim 1, wherein a frequency of the pulse width modulation signal is 2600 Hz.

3. The display device according to claim 1, wherein:

the intermediate gray scale signal includes two or more periods of the pulse width modulation signal, and each period of the two or more periods of the pulse width modulation signal includes the first pulse width modulation signal and the second pulse width modulation signal.

4. A display device comprising:

an input device;

a pulse width modulation signal generating part;

a drive circuit having two or more duty ratios;

a backlight including a plurality of light-emitting elements; and a display panel overlapping the backlight, wherein:

the pulse width modulation signal generating part is configured to:

set a duty ratio for each period of a pulse width modulation signal, and generate, based on a signal related to luminance from the input device, an intermediate gray scale signal including a signal that has a first pulse width modulation signal and a second pulse width modulation signal continuous to the first pulse width modulation signal, the first pulse width modulation signal and the second pulse width modulation signal corresponding to two duty ratios closest to each other among the two or more duty ratios, the drive circuit is configured to control the plurality of light-emitting elements of the backlight based on the intermediate gray scale signal, and the input device includes:

an illuminance sensor; and a luminance controller, wherein:

the illuminance sensor is configured to supply data related to a brightness change to the luminance controller, and the luminance controller is configured to supply a luminance change signal to the pulse width modulation signal generating part based on the data related to the brightness change, and the pulse width modulation signal generating part is configured to generate an interrupt signal generated for each period of the pulse width modulation signal based on the luminance change signal.

5. A display device comprising:

an input device;

a pulse width modulation signal generating part;

a drive circuit having two or more duty ratios;

a backlight including a plurality of light-emitting elements; and a display panel overlapping the backlight, wherein:

the pulse width modulation signal generating part is configured to:

set a duty ratio for each period of a pulse width modulation signal, and generate, based on a signal related to luminance from the input device, an intermediate gray scale signal including a signal that has a first pulse width modulation signal and a second pulse width modulation signal continuous to the first pulse width modulation signal, the first pulse width modulation signal and the second pulse width modulation signal corresponding to two duty ratios closest to each other among the two or more duty ratios, the drive circuit is configured to control the plurality of light-emitting elements of the backlight based on the intermediate gray scale signal, the intermediate gray scale signal includes two or more periods of the pulse width modulation signal, each period of the two or more periods of the pulse width modulation signal includes the first pulse width modulation signal and the second pulse width modulation signal, and continuous two periods of the pulse width modulation signal include one of the first pulse width modulation signal and the second pulse width modulation signal alone.

* * * * *